US008106902B2

(12) United States Patent
Ishii et al.

(10) Patent No.: US 8,106,902 B2
(45) Date of Patent: Jan. 31, 2012

(54) DISPLAY DEVICE

(75) Inventors: Masato Ishii, Tokyo (JP); Naruhiko Kasai, Yokohama (JP); Tohru Kohno, Kokubunji (JP); Hajime Akimoto, Kokubunji (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 905 days.

(21) Appl. No.: 12/135,312

(22) Filed: Jun. 9, 2008

(65) Prior Publication Data

US 2009/0066614 A1 Mar. 12, 2009

(30) Foreign Application Priority Data

Sep. 12, 2007 (JP) ..... 2007-237165

(51) Int. Cl.
*G09G 3/30* (2006.01)

(52) U.S. Cl. ..... 345/212

(58) Field of Classification Search ..... 345/76, 345/98, 520, 204, 211, 212
See application file for complete search history.

(56) References Cited

U.S. PATENT DOCUMENTS

| | | | | |
|---|---|---|---|---|
| 7,652,647 | B2 * | 1/2010 | Kageyama et al. | 345/82 |
| 7,773,080 | B2 * | 8/2010 | Sato et al. | 345/212 |
| 2004/0108518 | A1 * | 6/2004 | Jo | 257/200 |
| 2006/0022932 | A1 * | 2/2006 | Sagawa et al. | 345/98 |
| 2006/0097965 | A1 * | 5/2006 | Deane et al. | 345/76 |
| 2006/0132493 | A1 * | 6/2006 | Akima | 345/520 |
| 2007/0132693 | A1 * | 6/2007 | Akimoto et al. | 345/92 |
| 2008/0150845 | A1 * | 6/2008 | Ishii et al. | 345/77 |
| 2008/0218499 | A1 * | 9/2008 | Kohno et al. | 345/204 |

FOREIGN PATENT DOCUMENTS

| | | |
|---|---|---|
| JP | 10-49303 | 2/1998 |
| JP | 2005-300630 | 10/2005 |
| JP | 2006-91709 | 4/2006 |
| JP | 2006-317682 | 11/2006 |
| JP | 2007-94606 | 4/2007 |

* cited by examiner

*Primary Examiner* — Quan-Zhen Wang
*Assistant Examiner* — Tony Davis
(74) *Attorney, Agent, or Firm* — Antonelli, Terry, Stout & Kraus, LLP.

(57) ABSTRACT

A display device including independent power sources for a display use and a detection use, display elements, switches (21, 22 and 23) for independently connecting the power sources and the individual elements, a circuit (10) for controlling the switches, and a variable amplifier (16) as detection means, which reads a state of each pixel of a display panel section (2), which generates a read result in a controllable shape, and which can change-over a detection result from an external sensor section (3) and an internal detection result through a timing control, so as to convert the detection result into a value corresponding to a subject to-be-detected, whereby detections can be performed with a detection circuit of one loop.

8 Claims, 12 Drawing Sheets

45 46

| MODE | RESISTANCE VALUE |
|---|---|
| SETTING A | xx Ω |
| SETTING B | xx Ω |
| SETTING C | xx Ω |
| ⋮ | ⋮ |

44

DISPLAY DEVICE

CLAIM OF PRIORITY

The present application claims priority from Japanese application serial no. 2007-237165 filed on Sep. 12, 2007, the content of which is hereby incorporated by reference into this application.

BACKGROUND OF THE INVENTION

1. Field of the Invention

The present invention relates to a display device whose luminance is controllable in accordance with a current quantity applied to a display element, or a light emitting time period. More particularly, it relates to a display device which is configured of display elements represented by an emissive type, also termed "organic EL (ElectroLuminescence) or organic light emitting diodes".

2. Description of the Related Art

Owing to the spread of various information processors, there are various display devices complying with roles. Among them, a display employing organic EL elements (an organic EL display device) has been highlighted as a display device of emissive type. An OLED or the like light emitting element for use in the display device does not require backlight as in a liquid-crystal display (liquid-crystal display device), and it is suited to a lower power consumption. Moreover, as compared with the liquid-crystal display, the organic EL element has merits such as a higher pixel visibility and a higher response rate.

Further, the organic EL element has characteristics similar to those of a diode, and its luminance can be controlled by a current quantity which is caused to flow through the element. Driving methods in such an emissive type display device are disclosed in JP-A-2006-91709, etc. Besides, regarding a configuration in which a touch panel or the like input device is incorporated into such a display device, JP-A-10-49305, etc. can be mentioned.

As the characteristic of the organic EL element (OLED), the internal resistance value of the element changes, depending upon a service period or an ambient environment. Especially, the organic EL element has the property that, when the service period increases, the internal resistance heightens secularly, so a current to flow through the element decreases. Therefore, when the pixels of an identical place within a screen, for example, a menu display are lit up for a long time, an burn-in phenomenon occurs in the place. For coping with the burn-in phenomenon, the state of the pixel needs to be detected. A method for the detection is one in which the pixel state is detected in the blanking period of display data. In the blanking period, the pixel is not caused to emit light, and hence, a displaying voltage is not applied. Therefore, using a power source separate from a power source for the light emission, a certain fixed current is applied to the pixel in the blanking period, and a voltage in this state is detected, whereby a degradation in the burn-in is detected from the change of the voltage. Besides, since the current cannot be applied to the pixel during a display period, a circuit for the above detection is used only in the blanking period.

Meanwhile, in order to detect a temperature characteristic and an ambient brightness and to detect a touch panel or the like input sensor used, similar detection circuits are respectively necessitated. In furnishing the system of the display device with the detection circuits, further controllers or the like control means are necessitated for coping with the burn-in detection, the temperature characteristic detection and the ambient brightness detection, and a circuit scale becomes large.

SUMMARY OF THE INVENTION

An object of the present invention is to cope with the detection of the burn-in degradation of an OLED, the detection of the temperature characteristic of the OLED, the detection of a sensor panel, etc. by a circuit of one detection loop, and to share the circuit of one detection loop, thereby to reduce a circuit scale.

According to one aspect of performance of the invention, a display device includes independent power sources for a display use and a detection use, display elements, switches for independently connecting the power sources and the individual elements, a circuit for controlling the switches, and a variable amplifier as detection means, which has the function of reading the state of each pixel and the internal detection function of generating the read result in a controllable shape, and which can change-over a detection result from an external sensor and an internal detection result through a timing control, so as to convert the detection result into a value corresponding to a subject to-be-detected, whereby the detections can performed by the detection circuit of one loop.

In the above configuration, detection devices which are connected to the detection circuit are sequentially changed-over in a display period and a blanking period, and the gain and timing of an adaptive amplifier are controlled in accordance with the subject to-be-detected, thereby to obtain an image display device in which the plurality of detection devices are detectable with the identical detection circuit.

The circuit and controller of the detection loop are shared for a plurality of detection loops, whereby the circuit scale can be reduced.

By way of example, according to the first embodiment of the invention to be described later, an internal pixel state and an external detection device can be detected by an identical detection circuit. Besides, according to the second embodiment of the invention, a plurality of external detection devices and an internal pixel state can be detected by an identical detection circuit. In addition, according to the third embodiment of the invention, an internal pixel state and an external detection device which needs to be regularly detected can be detected by an identical detection circuit.

DESCRIPTION OF THE PREFERRED EMBODIMENTS

Now, the best mode for carrying out the present invention will be described in detail with reference to the drawings.

First Embodiment

Figure 1:
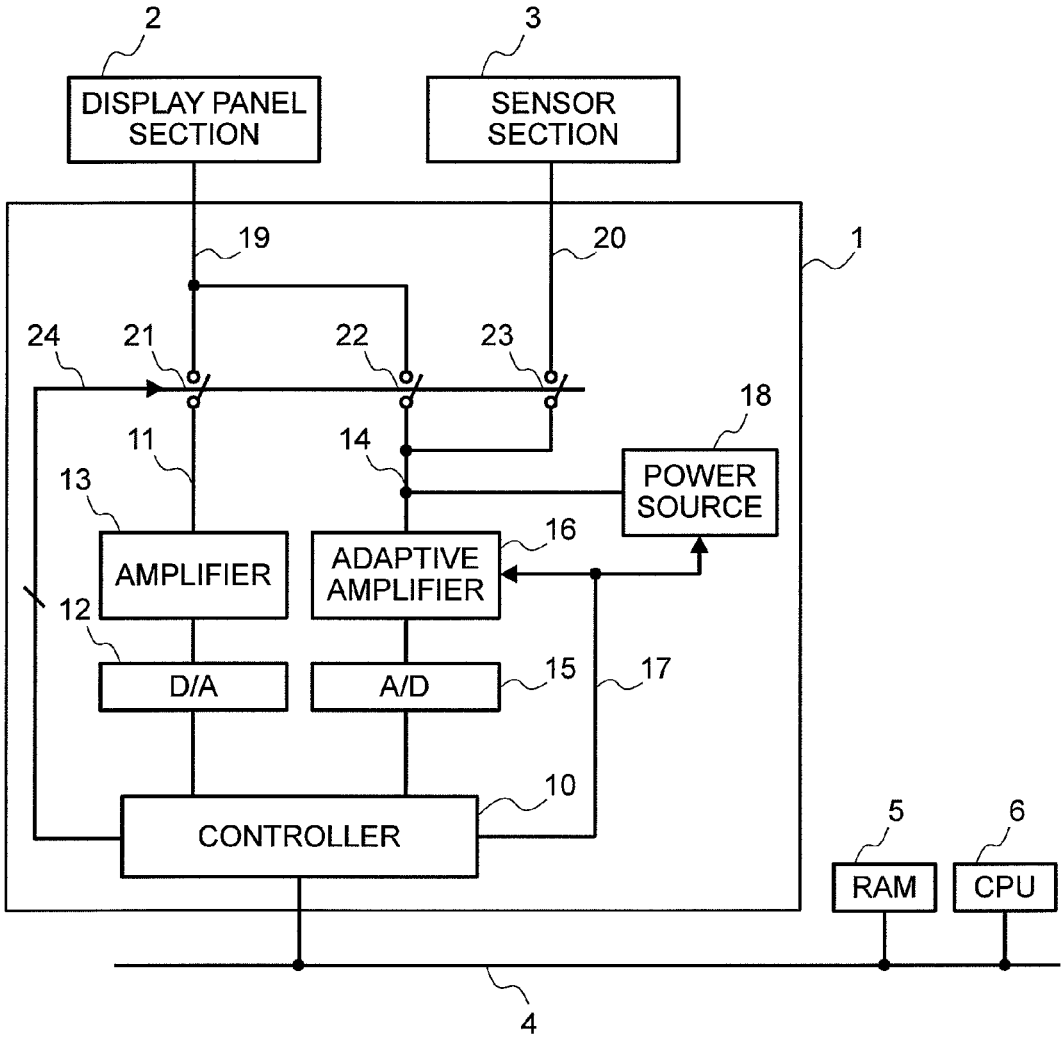
FIG. 1 is a system architectural diagram for explaining the whole configuration of an image display device according to the present invention.

FIG. 1 is a system architectural diagram for explaining the whole configuration of an image display device according to the invention. When broadly divided, the configuration consists of a display driver 1, a display panel section 2 and a sensor section 3. The display panel section 2 includes a plurality of pixel circuits which are matrix-arrayed in a row direction (scanning line direction) and a column direction (data line direction). The sensor section 3 includes operating environment sensors such as an burn-in sensor, a temperature sensor and an ambient light sensor, and external input equipments such as a touch panel being information input means.

A RAM 5 and a CPU 6 are connected to the display driver 1 through a control bus 4. Although only the RAM 5 and the CPU 6 are mentioned as principal devices here, other devices such as a ROM and various I/O controllers may well be connected. The display driver 1 includes a controller 10, which controls various portions within the display driver 1. Besides, the controller 10 performs the controls of writing detection data from the various sensors, into the RAM 5, and fetching display data to be displayed in the display panel section 2, from the RAM 5.

A data line 11 and a detection line 14 are connected to the controller 10. Although only one data line 11 and only one detection line 14 are shown in FIG. 1, such lines are actually laid in the number of columns (the number of data lines) of the pixels of a display panel constituting the display panel section 2. A D/A converter 12 and an amplifier 13 exist on the data line 11. Besides, an A/D converter 15, an adaptive amplifier 16 and a power source 18 exist on the detection line 14. The data line 11 is also an output line from the controller 10. The display data and precharge data are outputted to the output line so as to be inputted to the D/A converter 12, the output value of which is amplified by the amplifier 13. The data line 14 is also an input line to the controller 10.

The input line serves to input several sorts of detection results to the controller 10. The detection results are converted into digital values by the A/D converter 15 through the adaptive amplifier 16, and the digital value is inputted to the controller 10. The adaptive amplifier 16 plays the role of clamping detection values of different voltage levels into a certain fixed range. The controller 10 controls the adaptive amplifier 16 and the detecting power source 18 through a control line 17. The driver 1 and the display panel section 2 are connected by a control line 19, while the driver 1 and the sensor section 3 are connected by a control line 20.

The control line 19 is connected with the data line 11 through a switch 21, and with the detection line 14 through a switch 22. The control line 20 is connected with the detection line 14 through a switch 23. The switches 21, 22 and 23 are controlled by a control line 24 led from the controller 10. The control line 24 may control the switches 21, 22 and 23 either independently or collectively, and this control line 24 is configured of a plurality of lines in the case of the independent controls. Various detection devices which include the temperature sensor, an illuminance sensor, a chromaticity sensor and a sound sensor, and the touch panel and other input devices, can be connected in the sensor section 3.

Figure 2:
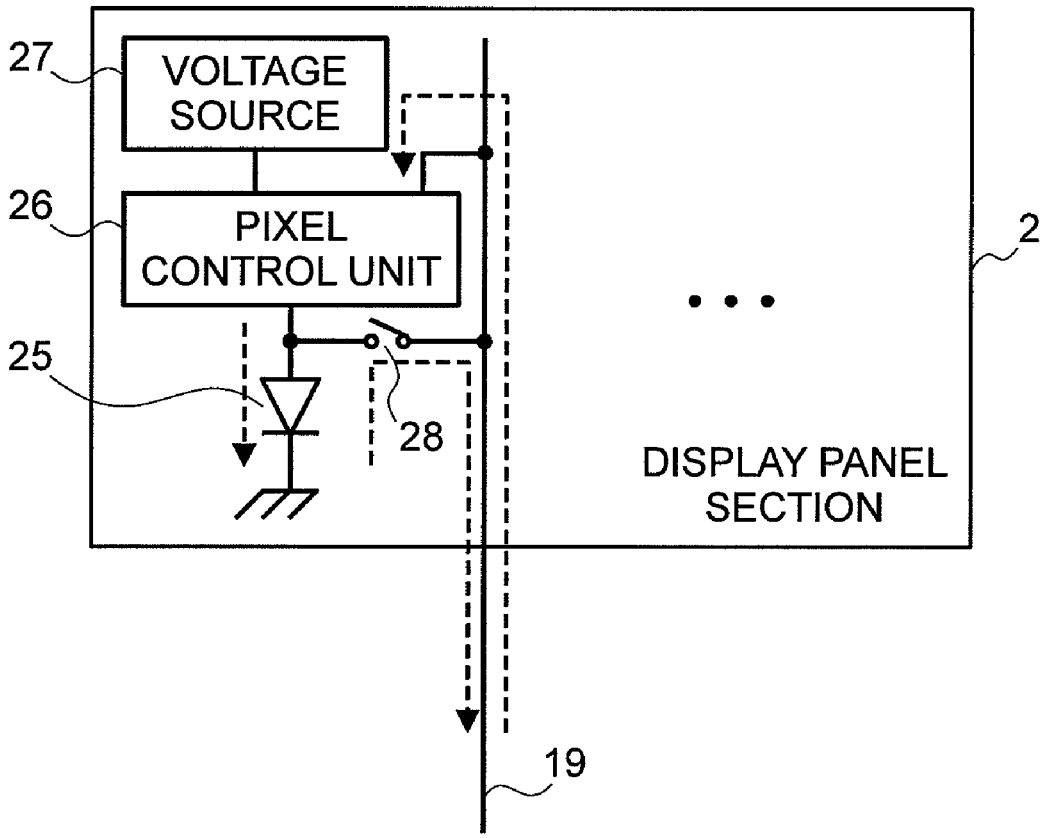
FIG. 2 is a diagram for explaining the configuration of a pixel which exists within a display panel section 2 in FIG. 1.

FIG. 2 is a diagram for explaining the configuration of the pixel which exists within the display panel section 2 in FIG. 1. The invention relates to the image display device, and an organic EL display device (OLED) will be described as one example of the image display device here. Referring to FIG. 2, a voltage source 27 is a displaying power source, and it is connected with a display element 25 by a pixel control unit 26. The control line 19 serves as an input/output line for sending and receiving data. An input to the display panel section 2, that is, display data is processed by the pixel control unit 26 so as to drive the display element 25 by the displaying power source 27. An output from the display panel unit 2, that is, detection data passes through a selection switch 28 from the display element 25, and it is inputted to the driver 1 through the control line 19. The drive power source of the display element 25 on this occasion is the power source 18. Since the detection data indicates a pixel state, it can be used for the detection of burn-in.

Figure 3A:
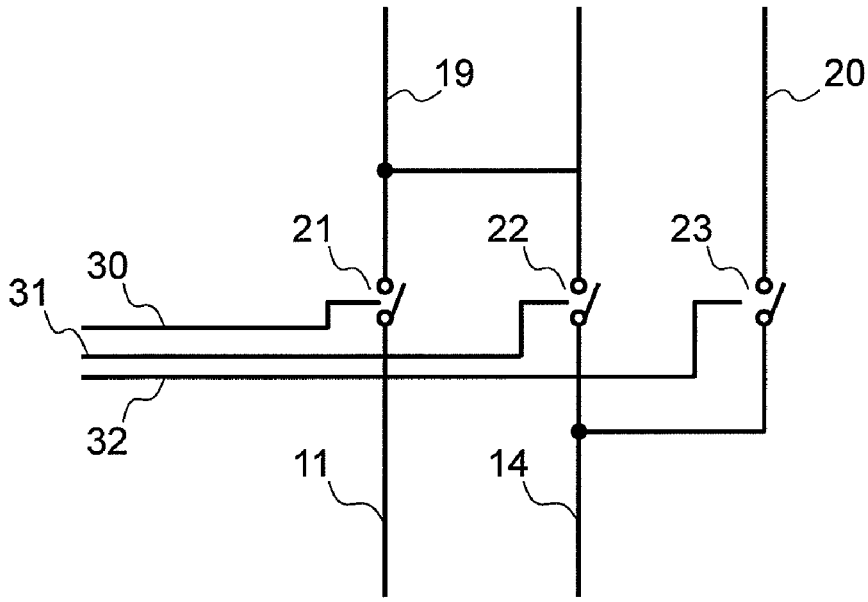
FIGS. 3A and 3B are circuit diagrams for explaining configurational examples of changeover switches within a driver 1 in FIG. 1, respectively.
Figure 3B:
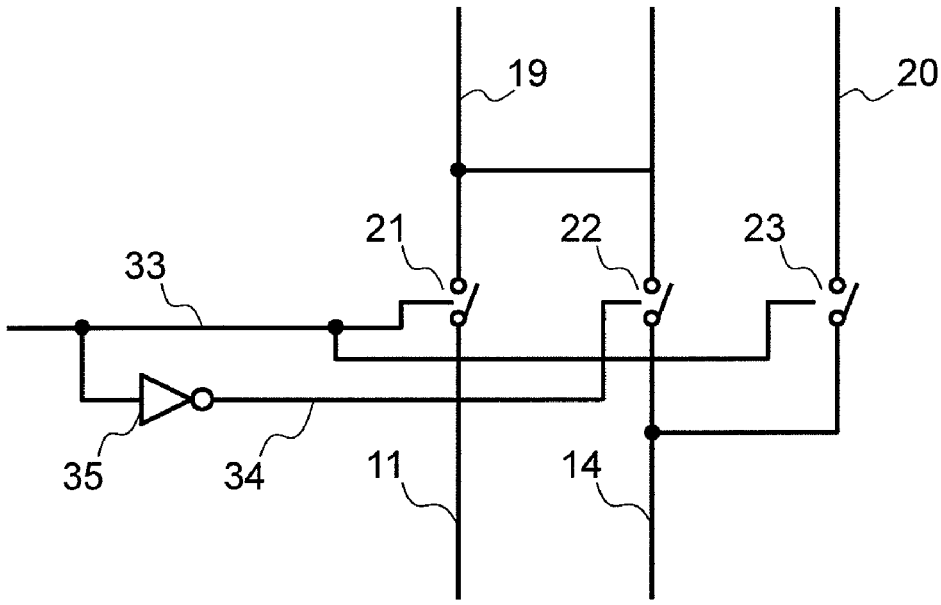

FIGS. 3A and 3B are circuit diagrams for explaining configurational examples of the changeover switches within the driver 1 in FIG. 1, respectively. FIG. 3A shows the configuration in which the respective switches are controlled by independent lines. Here, the control line 30 controls the connection of the control line 19 and the data line 11 by the switch 21. Besides, the control line 31 controls the connection of the control line 19 and the detection line 14 by the switch 22. In addition, the control line 32 controls the connection of the control line 20 and the detection line 14 by the switch 23. Since the control lines 30, 31 and 32 can perform the control operations independently of one another, the ON/OFF operations of the switches 21, 22 and 23 can be respectively controlled at any desired timings.

On the other hand, FIG. 3B shows the configuration in which the respective switches are uniquely controlled. A control line 33 controls the connection of the control line 19 and the data line 11 by the switch 21, and it controls the connection of the control line 20 and the detection line 14 by the switch 23. Besides, an inverter 35 serves to invert the signal of the control line 33, and a control line 34 receiving the output of the inverter 35 controls the connection of the control line 19 and the detection line 14 by the switch 22. The control lines 33 and 34 bear inverted signals, so that the switch 22 falls into an OFF state when the switches 21 and 23 are in ON states, and it falls into an ON state when the switches 21 and 23 are in OFF states. These operations are simultaneously performed. In FIG. 3A, the number of the control lines is large, but any desired switch controls are possible. In FIG. 3B, the number of the control lines is small, but the operations are fixed.

Figures 4A, 4B:
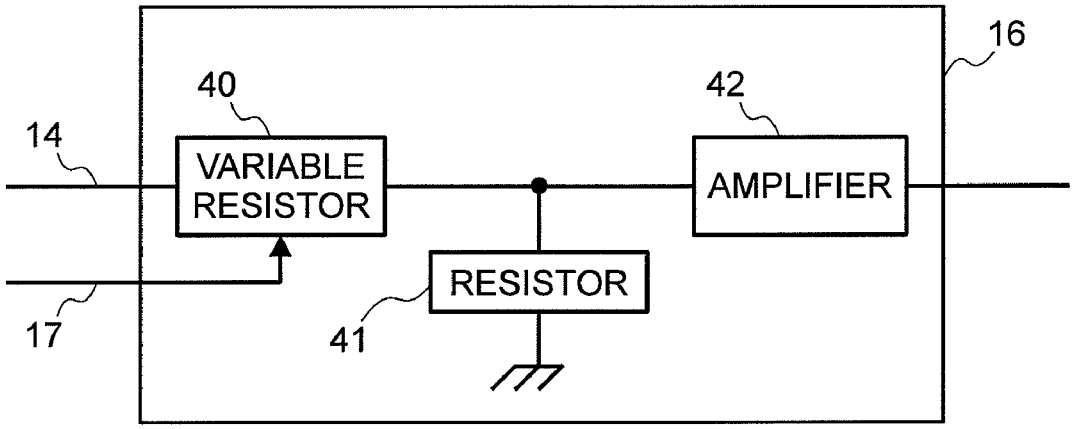
FIGS. 4A and 4B are diagrams for explaining the configuration of an adaptive amplifier 16 in FIG. 1, respectively.

FIGS. 4A and 4B are diagrams for explaining the configuration of the adaptive amplifier 16 in FIG. 1. FIG. 4A shows the internal configuration of the adaptive amplifier 16. This adaptive amplifier 16 includes a variable resistor 40 which can be controlled by the control signal 17 from the controller 10, a fixed resistor 41, and an amplifier 42.

FIG. 4B shows the contents of a table 44 which indicates the set modes 45 of the adaptive amplifier 16 and the resistance values 46 of the variable resistor 40. Each set mode 45 pairs with a subject for detection. The controller 10 selects the set mode 45 in accordance with the detection range of the detection portion, and it sets the amplifier by using the resistance value 46 corresponding to the set mode. In a case where the resistance values 46 are used as fixed values, the table 44 may be stored in a memory within the driver 1, and it may well be stored in a memory outside the driver 1. On the other hand, in a case where the resistance values 46 are set at any desired values, they may be dynamically computed in conformity with the set modes 45.

Figure 5:
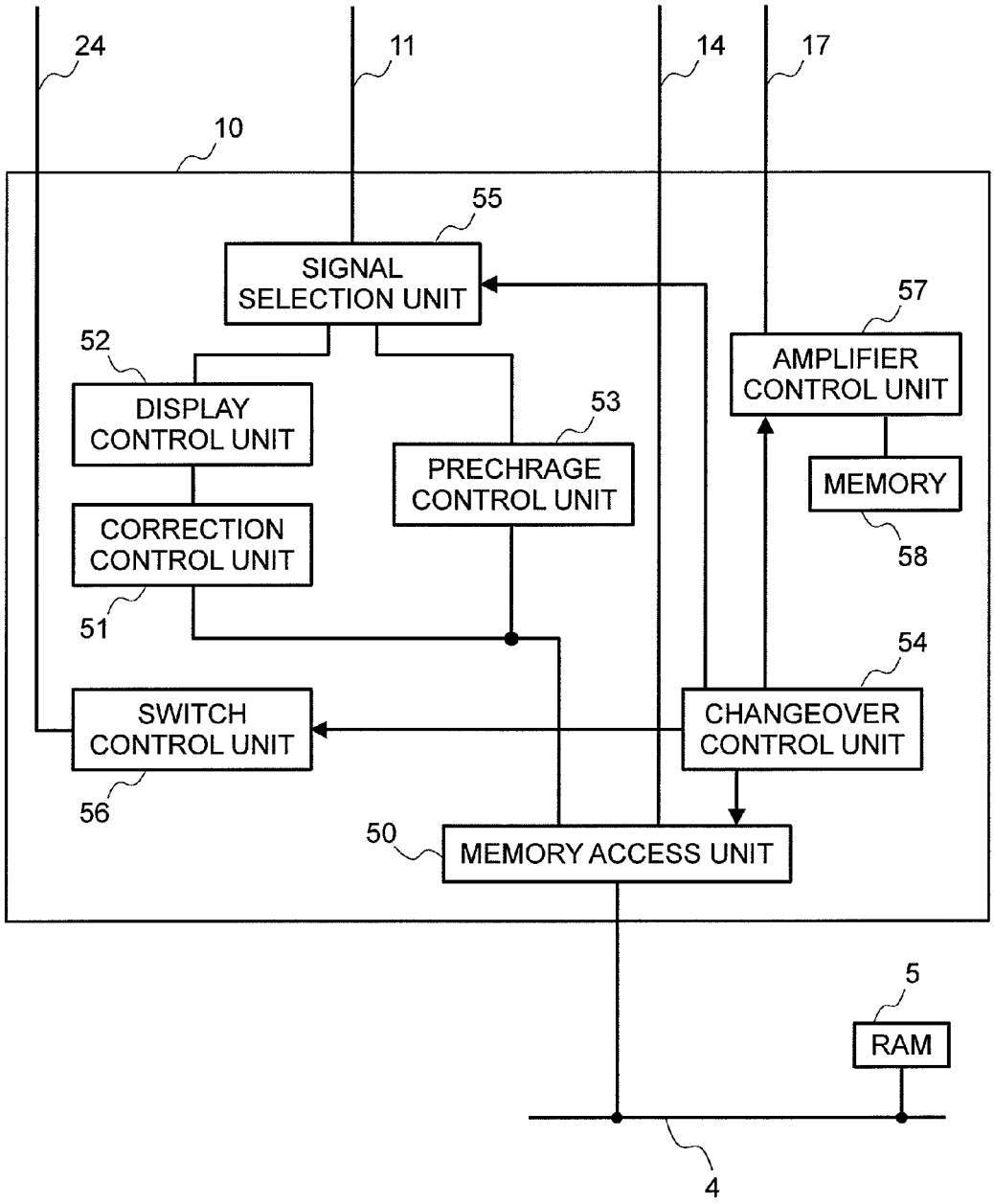
FIG. 5 is a system architectural diagram for explaining the internal configuration of a controller 10 in FIG. 1.

FIG. 5 is a system architectural diagram for explaining the internal configuration of the controller 10 in FIG. 1. Referring to FIG. 5, outside the driver 1, a memory access unit 50 sends and receives data to and from the RAM 5 which is an external memory connected by the bus 4. Besides, inside the driver 1, the memory access unit 50 is connected with a correction control unit 51 and a display control unit 52 which are used in a display mode, and a precharge control unit 53 which is used in a detection mode, a switch control unit 56, and an amplifier control unit 57. The correction control unit 51 is a calculation unit for subjecting display data to correction processing on the basis of data obtained by detection. Regarding the correction processing, separate processes are executed for the sorts of the detections of a detection loop. By way of example, in case of the burn-in detection, a degradation is corrected in correspondence with the degree of burn-in, and in case of the temperature characteristic detection, a temperature fluctuation component is corrected.

The display control unit 52 transmission-controls the display data corrected by the correction control unit 51, in agreement with the timing of the display panel. The precharge control unit 53 fixes the voltage of the data line 11 in the detection mode, and it is used for improving a response rate. A changeover control unit 54 adjusts a signal timing within the controller 10 and the timing of an external signal. A signal selection unit 55 changes-over the outputs of the display control unit 52 and the precharge control unit 53 and transmits either output to the data line 11 under the control of the changeover control unit 54. The switch control unit 56 controls the control line 24.

This control line 24 controls the selection switches of lines led to the data line 11 and the detection line 14, and it consists of a single line or a plurality of lines in accordance with the control configuration of the switches. The amplifier control unit 57 controls the state of the adaptive amplifier from the changeover control unit 54, and in the case of employing the setting table in order to set the adaptive amplifier, and this amplifier control unit 57 alters the setting of the adaptive amplifier with the setting information of the table prepared in a memory 58.

Figure 6:
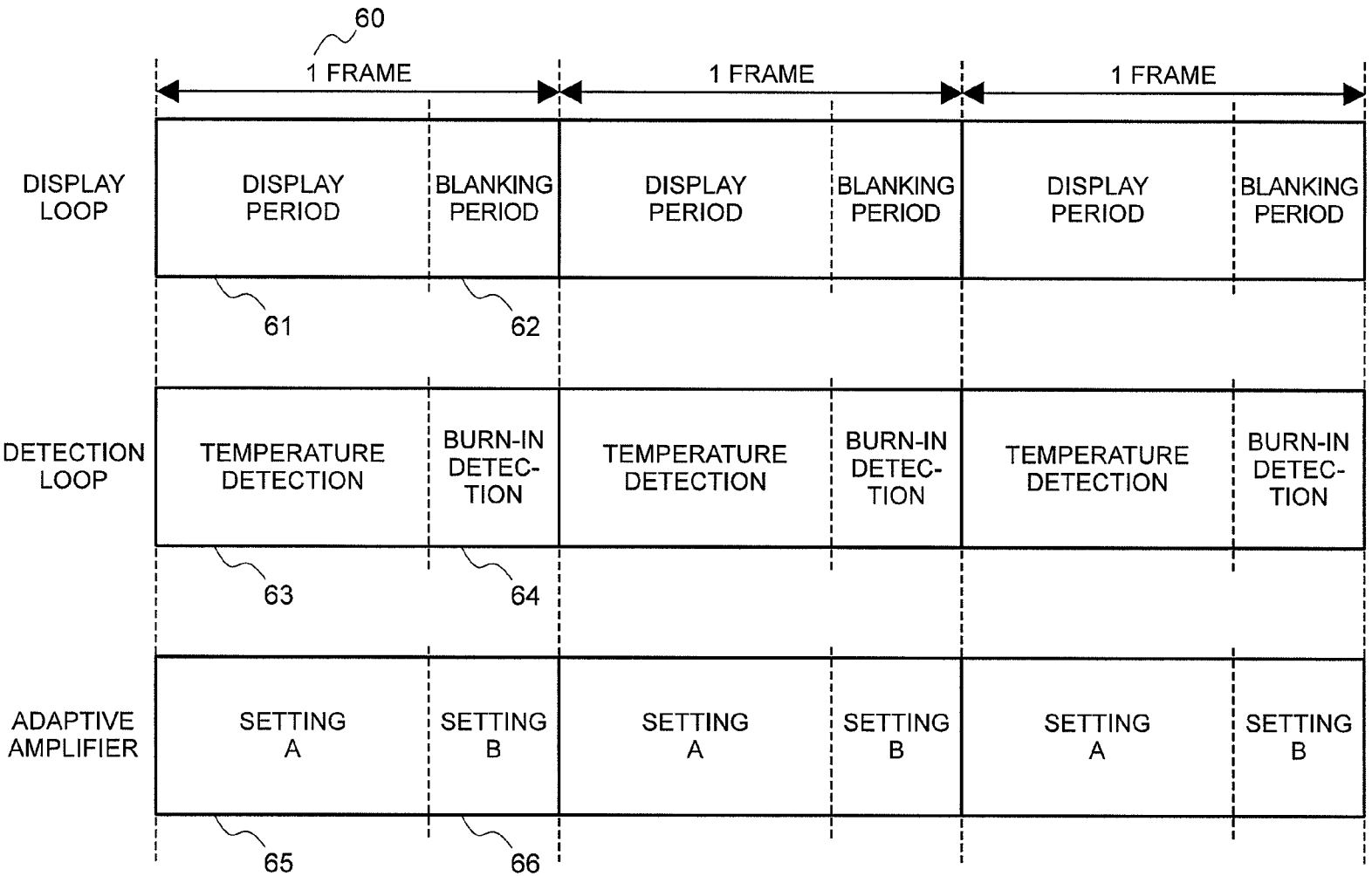
FIG. 6 is a diagram for explaining the timings of displays and detections in the first embodiment of the invention.

FIG. 6 is a diagram for explaining the timings of displays and detections in the first embodiment of the invention. In this embodiment, the timings are those of the displays, the temperature detections, and the burn-in detections. Reference numeral 60 designates one frame period, which is constituted by a display period and a blanking period (non-display period) in a display loop. The display period may well further include a write period for writing the display data or display voltage into the pixel circuit, and a display (luminescence) period which presents a display (luminescence) in accordance with the written display data or display voltage. In a detection loop, one frame period 60 is constituted by a temperature detection period and an burn-in detection period. Within one horizontal period, the display period and the blanking period (non-display period) may well be included in the display loop, and the temperature detection period and the burn-in detection period in the detection loop. The timings will be explained on the basis of the configuration shown in FIG. 3A. It is assumed that the display panel is connected to the control line 19, while the temperature detection sensor is connected to the control line 20. In the control of the control loop, in order to connect the data line 11 and the control line 19 in the display period 61, the switch 21 is turned ON by the control line 30, and the switch 22 is turned OFF by the control line 31.

Besides, this period corresponds to the temperature detection period 63 in the detection loop. In the control of the detection loop, the switch 23 is turned ON by the control line 32 in order to connect the detection line 14 and the control line 20 for the purpose of the temperature detection. Thus, in these periods, the temperature detection is performed while the display is being presented. Subsequently, in the control of the display loop, in order to connect the detection line 14 and the control line 19 in the blanking period 62, the switch 22 is turned ON by the control line 31, and the switch 21 is turned OFF by the control line 30. This period corresponds to the burn-in detection period 64 in the detection loop. In the control of the detection loop, the switch 23 is turned OFF by the control line 32 in order to disconnect the detection line 14 and the control line 20.

Thus, in such a period, the pixel state (for example, a voltage or current) is detected. Besides, in a case where the setting of the temperature detection state is a setting-A 65 and where the setting of the burn-in detection state is a setting-B 66, the adaptive amplifier is set in the state of the setting-A 65 during the temperature detection period 63, and it is set in the state of the setting-B 66 during the burn-in detection period 64, whereby the state of the amplifier is set. These operations are performed every frame, and the displays and detections are made compatible.

Figure 7:
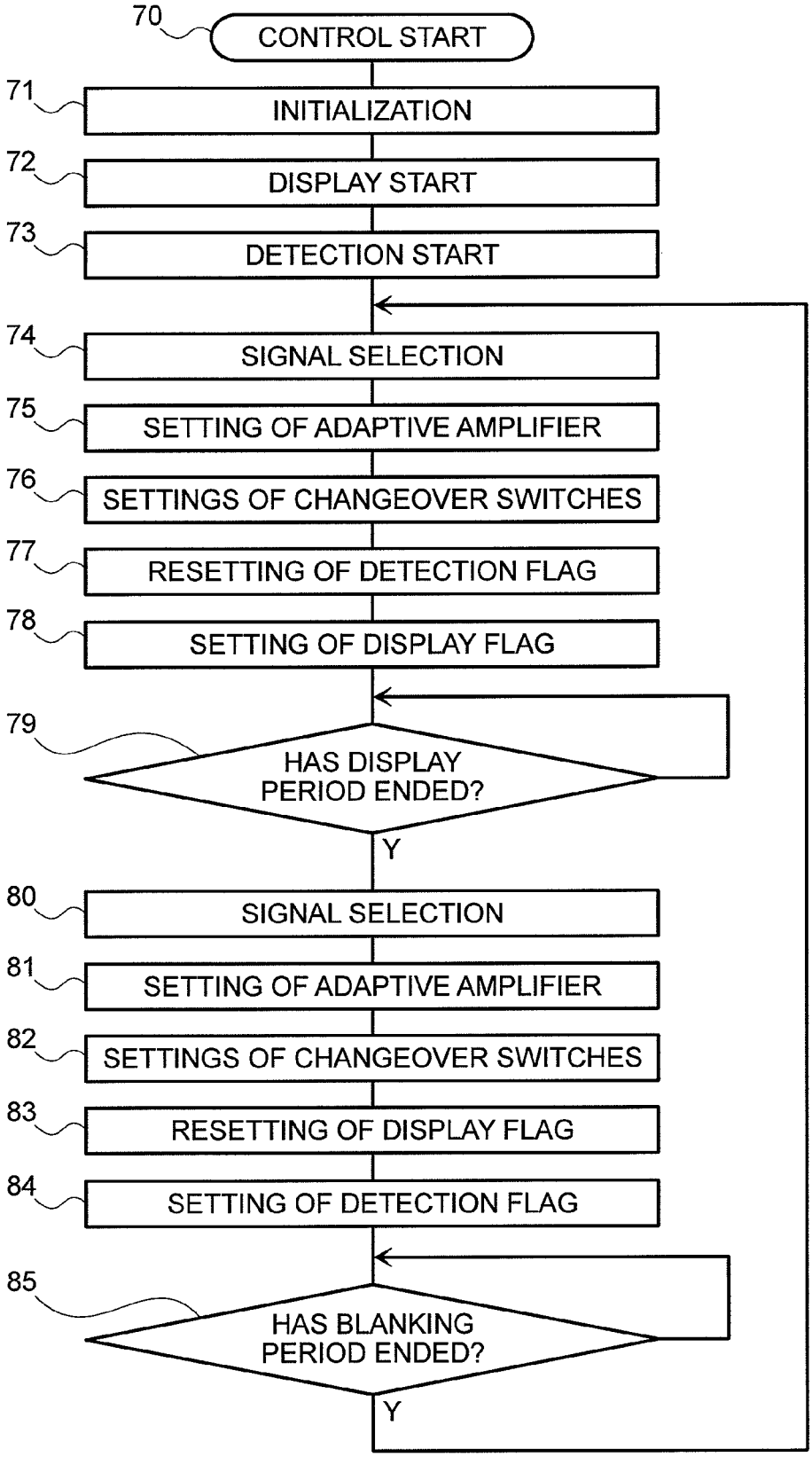
FIG. 7 is a control flow chart of the controller 10 in FIG. 1.

FIG. 7 is a control flow chart of the controller 10 in FIG. 1. When the controller 10 starts its control at a control start step 70, the routine shifts to a step 71. Initialization processing is performed at the step 71, followed by a step 72. A display operation is started at the step 72, followed by a step 73. At the step 73, a detection operation is started. In the initialization processing at the step 71, the initialization controls of various states and state inspections are carried out, thereby to initialize the interior of the system. Although the operations at the steps 72 and 73 will be stated later, the interior of the controller 10 is initialized by these steps.

Subsequently, at a step 74, the signal selection unit 55 within the controller 10 is changed-over. At a step 75, the adaptive amplifier is set by the control line 17. At a step 76, the changeover switches are set by the control line 24. A detection flag is reset at a step 77, and a display flag is set at a step 78. The detection flag and the display flag are contained within the controller 10, and they serve to store the state of the display loop. The display period is decided at a step 79. The decision of the display period is rendered by a timer or a counter.

In a case where the display period has ended, it is shifted to the blanking period. The signal selection unit 55 within the controller 10 is changed-over at a step 80. The adaptive amplifier is set by the control line 17 at a step 81. The changeover switches are set by the control line 24 at a step 82. The display flag is reset at a step 83, and the detection flag is set at a step 84. The blanking period is decided at a step 85. The decision of the blanking period is rendered by a timer or a counter. In a case where the blanking period has ended, it is shifted to the display period, and the routine shifts to the step 74. In this example, the display flag and the detection flag are simultaneously changed-over, but they can also be changed-over with a time difference.

Figure 8:
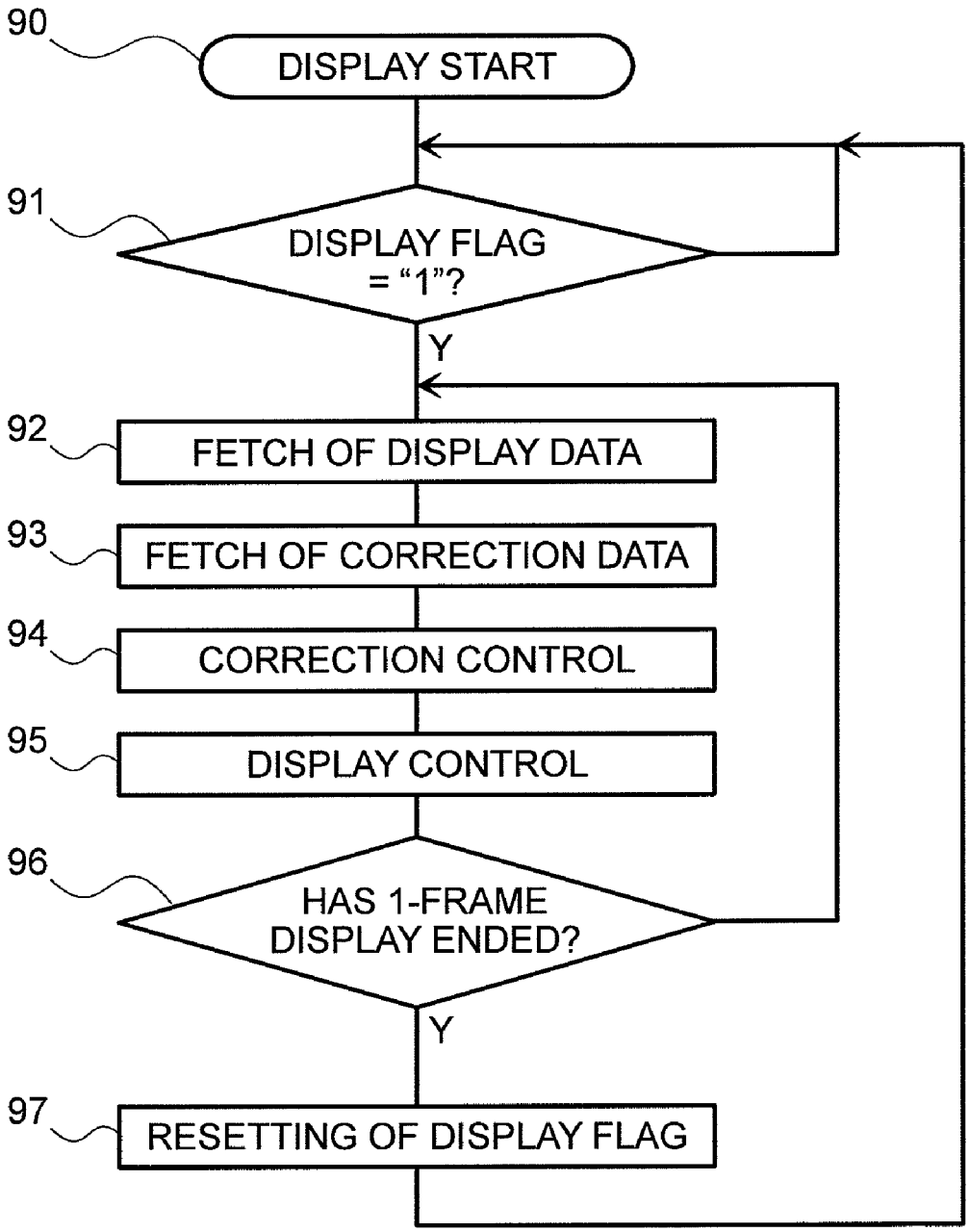
FIG. 8 is a control flow chart of a control loop in FIG. 1.

FIG. 8 is a control flow chart of the display loop in FIG. 1. When the process of the display loop is started at a step 90, the state of the display flag is monitored at a step 91. In a case where the display flag is "0", the monitoring is continued at the step 91. When the display flag changes to "1", the routine shifts to a step 92, at which the memory controller unit fetches display data. Further, the memory controller unit fetches correction data at a step 93, and conversion data are created from the display data and the correction data at a step 94. The conversion data are transmitted to the display unit at a step 95. At a step 96, if the display period of one frame has ended is decided. In a case where the display of one frame has not ended, the routine is repeated from the step 92, and the display data are transmitted to the display panel. When the display of one frame has ended, the routine shifts to a step 97, at which the display flag is reset. In addition, the routine shifts to the step 91 so as to continue the monitoring of the display flag state.

Figure 9:
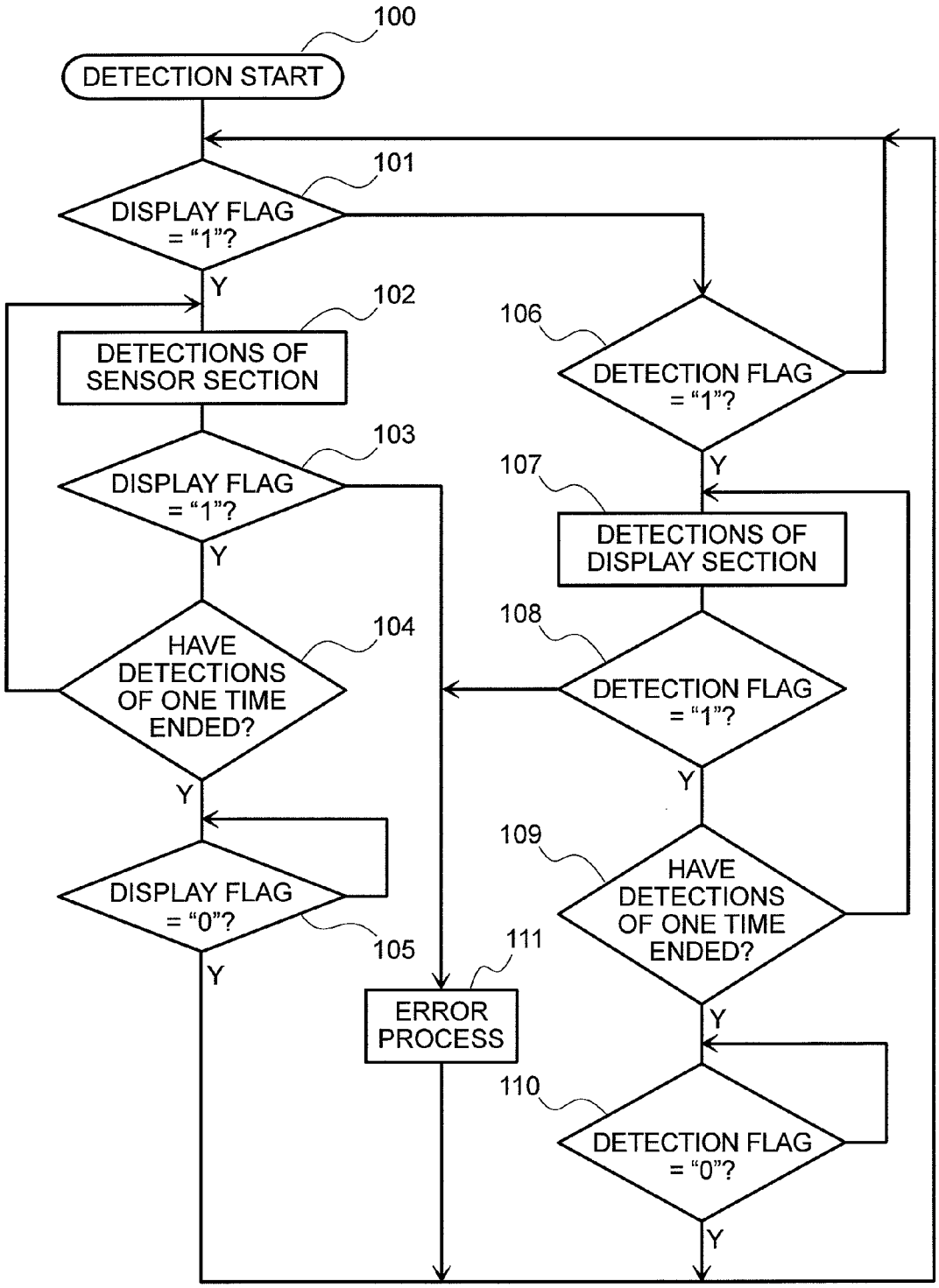
FIG. 9 is a control flow chart of a detection loop in FIG. 1.

FIG. 9 is a control flow chart of the detection loop in FIG. 1. When the process of the detection loop is started at a step 100, the state of the display flag is monitored at a step 101. When the display flag changes to "1", that is, the display period begins, the detections of the sensor section are performed at a step 102. If the display flag is in the state of "1" at a step 103, whether or not all the detections of one time have ended is judged at a step 104. When all the detections have not been ended, the operations from the step 102 are repeated. In a case where the display flag is "0" at the step 103, it is indicated that the display period has ended in the course of the detection. Therefore, the routine shifts to a step 111.

In a case where all the detections of one time have ended at the step 104, the routine shifts to a step 105. In a case where the display flag is "1" at the step 105, the routine waits until the display flag becomes "0". When the display flag changes to "0", the routine shifts to the step 101. In a case where the display flag is "0" at the step 101, the routine shifts to a step 106. In a case where the detection flag is "0" at the step 106, the routine shifts to the step 101, at which the state of the display flag is monitored. On the other hand, in a case where the detection flag is "1" at the step 106, the routine shifts to a step 107. Detections from the display panel section are performed at the step 107.

If the detection flag is in the state of "1" at a step 108, whether or not all the detections of one time have ended is judged at a step 109. When all the detections have not been ended, the operations from the step 107 are repeated. In a case where the detection flag is "0" at the step 108, it is indicated that the blanking period has ended in the course of the detection. Therefore, the routine shifts to the step 111. In a case where all the detections of one time have ended at the step 109, the routine shifts to a step 110. In a case where the detection flag is "1" at the step 110, the routine waits until the detection flag becomes "0". When the detection flag changes to "0", the routine shifts to the step 101. The step 111 executes an error process. As an example of the error process, in a case where the display period or the detection period has timed-out, a procedure is traced in which the interrupted state of the routine is transmitted from the controller 10 to the CPU 6, and in which the CPU 6 having received the signal executes the exceptional process of the operating system.

Second Embodiment

Figure 10:
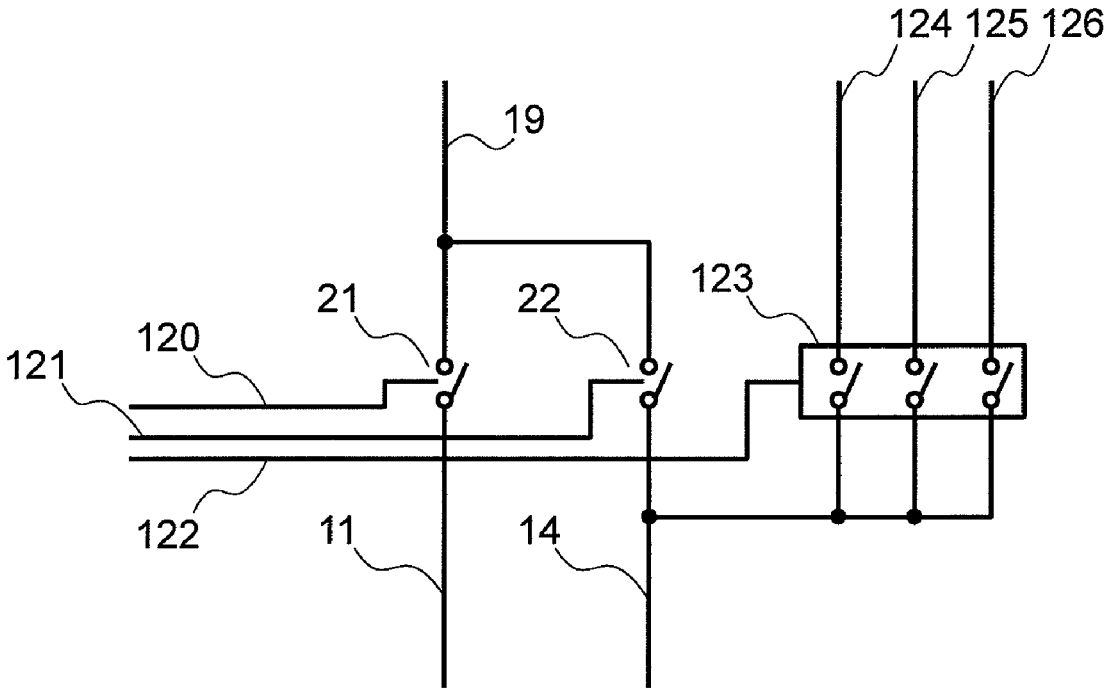
FIG. 10 is a circuit diagram for explaining the second embodiment of the invention, in which parts relevant to FIGS. 3A and 3B for explaining the first embodiment are differently configured.

FIG. 10 is a circuit diagram for explaining the second embodiment of the invention, in which parts relevant to FIGS. 3A and 3B for explaining the first embodiment are differently configured. The configuration is a configuration in which inputs from a plurality of sensor sections are used for a detection loop, and it is a configuration in which respective switches are controlled by independent lines. A control line 120 controls the connection of the control line 19 and the data line 11 by the switch 21.

A control line 121 controls the connection of the control line 19 and the detection line 14 by the switch 22. A control line 122 controls the connection of the detection line 14 and any desired one of control lines 124, 125 and 126 by the corresponding one of the switches 123. Since the control lines 120, 121 and 122 can perform the independent controls, the ON/OFF operations of the switches 21, 22 and 123 can be controlled at any desired timings. Further, the switches 123 have a kind of selector configuration. Therefore, in a case where the control line 122 is formed of a single line, the switches 123 can be sequentially changed-over, and in a case where the control line 122 is formed of a plurality of lines, any desired changeover of the switches 123 becomes possible. The sorts of sensors which are changed-over by the switches 123 may be in any number.

Figure 11:
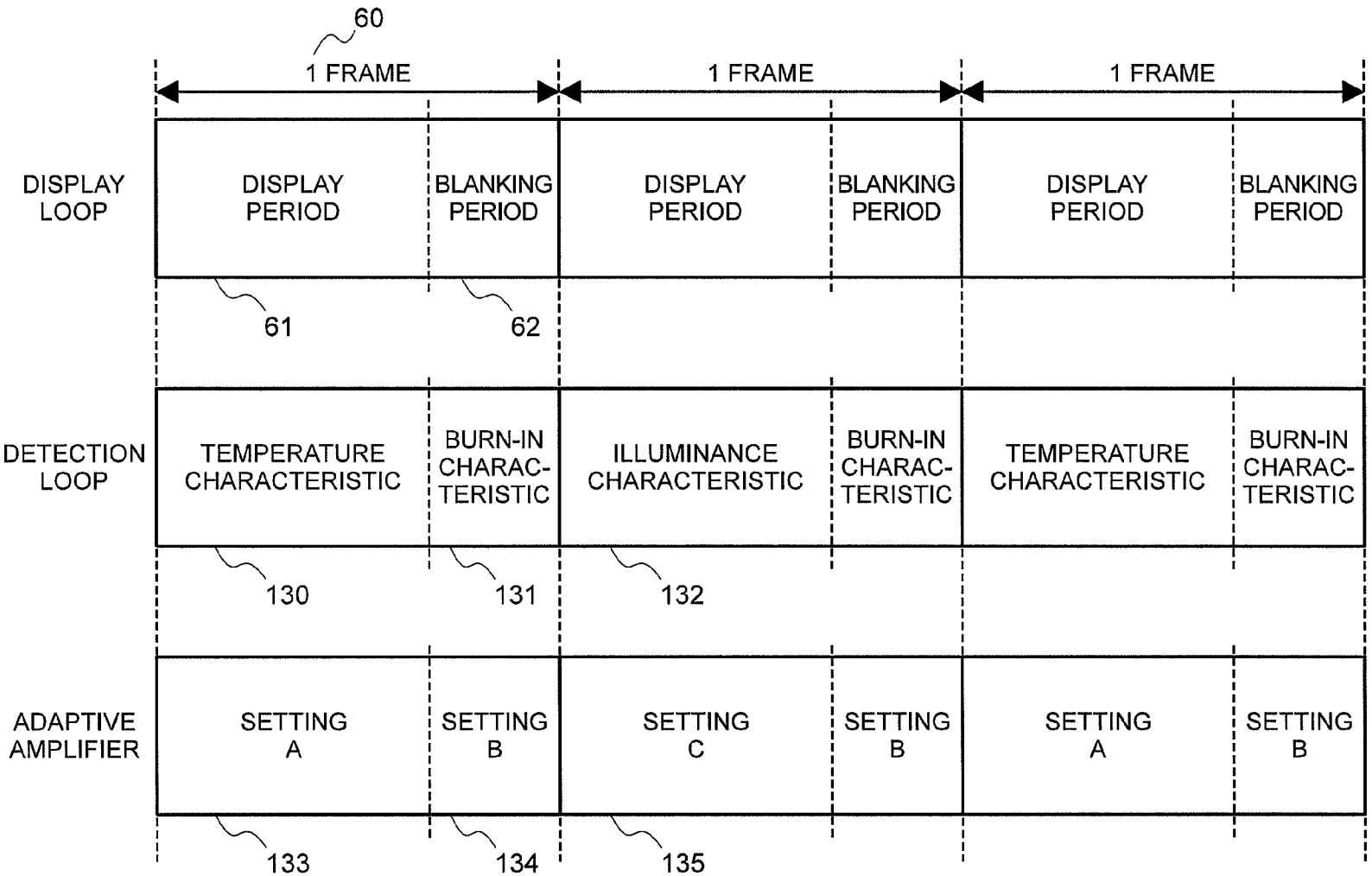
FIG. 11 is a diagram for explaining the timings of displays and detections in the second embodiment of the invention.

FIG. 11 is a diagram for explaining the timings of displays and detections in the second embodiment of the invention. FIG. 11 indicates the timings in the case where the sensors connected to the switches 123 in FIG. 10 detect a temperature and an illuminance alternately. Reference numeral 60 designates one frame period, which is constituted by a display period and a blanking period in a display loop. The detection loop is constituted by a temperature detection period, an illuminance detection period, and an burn-in detection period. It is assumed that the display panel is connected to the control line 19, that the temperature detection sensor is connected to the control line 124, and that the illuminance detection sensor is connected to the control line 125.

In the control of the display loop, in order to connect the data line 11 and the control line 19 in a display period 61, the switch 21 is turned ON by the control line 120, and the switch 22 is turned OFF by the control line 121. Besides, in such a period, a temperature detection period 130 and an illuminance detection period 132 are alternately set every frame in the detection loop. In the control of the detection loop, accordingly, the switches 123 are selected by the control line 122 in order to connect the detection line 14 and the control line 124 when the temperature is detected, and to connect the detection line 14 and the control line 125 when the illuminance is detected. Thus, in these periods, the detections of the sensor sections are performed while displays are being presented.

Subsequently, in the control of the display loop, in order to connect the detection line 14 and the control line 19 in the blanking period 62, the switch 22 is turned ON by the control line 121, and the switch 21 is turned OFF by the control line 120. This period corresponds to an burn-in detection period 131 in the detection loop. In the control of the detection loop, in order to disconnect the detection line 14 and the control line 124 or 125, all the switches 123 are turned OFF by the control line 122. Thus, a pixel state is detected in such a period.

Besides, in a case where the setting of the temperature detection state is a setting-A 133, where the setting of the burn-in detection state is a setting-B 134, and where the setting of the illuminance detection state is a setting-C 135, the adaptive amplifier is set in the state of the setting-A 133 during the temperature detection period 130, it is set in the state of the setting-B 134 during the burn-in detection period 131, and it is set in the state of the setting-C 135 during the illuminance detection period 132, whereby the state of the amplifier is set. The detection operations by the different sensors are performed in 2-frame units, and the displays and detections are made compatible.

Third Embodiment

Figure 12:
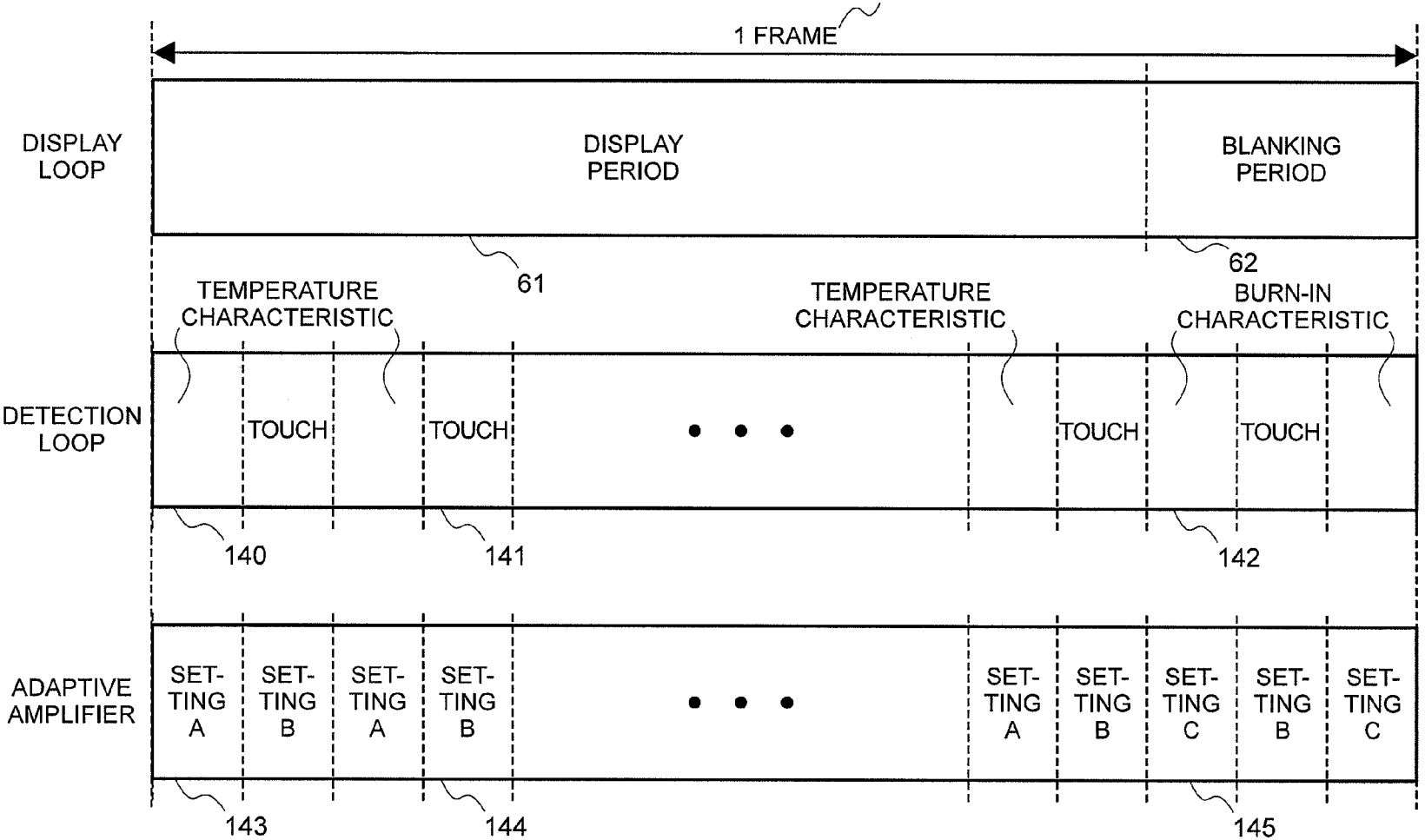
FIG. 12 is a diagram for explaining the timings of displays and detections in the third embodiment of the invention.

FIG. 12 is a diagram for explaining the timings of displays and detections in the third embodiment of the invention. In FIG. 12, parts relevant to FIG. 11 for explaining the second embodiment are differently configured. The configuration is a configuration in which inputs from a plurality of sensor sections are used for a detection loop. Especially, FIG. 12 is a timing diagram in the case where a sensor which needs must perform the detection in a certain cycle is coped with. This example indicates the timings in the case where the sensors connected to the switches 123 in FIG. 10 detect a temperature and the touch coordinates of a touch panel alternately.

An input device such as the touch panel needs to be accessed at fixed intervals, and when the interval of the access changes, an inconvenience sometimes occurs in a process after the detection. That is, a highest priority level can be set for the specified input device. Reference numeral 60 designates one frame period, which is constituted by a display period and a blanking period in a display loop. In the detection loop, one frame period is constituted by temperature detection periods, touch panel detection periods, and burn-in detection periods.

It is assumed that the display panel, the temperature detection sensor and the touch panel sensor are respectively connected to the control line 19, the control line 124 and the control line 125. In the control of the display loop, in order to connect the data line 11 and the control line 19 in the display period 61, the switch 21 is turned ON by the control line 120, and the switch 22 is turned OFF by the control line 121. Besides, in this period, the temperature detection periods 140 and the touch panel detection periods 141 are alternately set within one frame in the detection loop. In the control of the detection loop, the switches 123 are selected by the control line 122 in order to connect the detection line 14 and the control line 124 when the temperature is detected, and to connect the detection line 14 and the control line 125 when the touch panel is detected. Thus, in such a period, the detections of the sensor sections are performed while the display is being presented.

Subsequently, in the control of the display loop, the switch 21 is turned OFF by the control line 120 during the blanking period 62. In this embodiment, the control line 125 needs to be connected to the control line 14 even during the blanking period. Therefore, in order to alternately connect the control line 19 and the control line 125 to the detection line 14, either of the switch 22 and the switch 123 is turned ON, and the other of them is turned OFF, by the control line 121 and the control line 122. Thus, an burn-in detection period 142 is set in a state where the detection line 14 and the control line 19 are connected, and the touch panel detection period 141 is set in a state where the detection line 14 and the control line 125 are connected.

Besides, in a case where the setting of the temperature detection state is a setting-A 143, where the setting of the touch panel detection state is a setting-B 144, and where the setting of the burn-in detection state is a setting-C 145, the adaptive amplifier is set in the state of the setting-A 143 during the temperature detection period 140, in the state of the setting-B 144 during the touch panel detection period 141, and in the state of the setting-C 145 during the burn-in detection period 142, whereby the state of the amplifier is set. The series of detection operations are performed in single-frame units, and the displays and the detections are made compatible.

The invention is applicable to a simple display device or a panel incorporating the display device, or the display device of an information processing terminal.

What is claimed is:

1. An image display device comprising:

a display section having a pixel area configured of a plurality of display pixels each of which has its light emission quantity changed in accordance with a current quantity;

a first signal line which is connected to the display section;

a second signal line which is connected to a sensor unit which detects an external state;

an output circuit which outputs a display signal voltage;

a detection circuit;

a first switch circuit;

a second switch circuit which connects, in a display period of the display signal voltage to be output by the output circuit, the first signal line to the output circuit in order to input the display signal voltage into the pixel area, and connects, in a blanking period of the display signal voltage not to be output by the output circuit, the first signal line to the first switch circuit in order to input a pixel state into the first switch circuit;

a pixel state outputting power source connected to the second switch circuit;

a pixel control circuit for controlling the light emission quantity which corresponds to the display signal voltage;

a displaying power source connected to said pixel control circuit;

wherein the first switch circuit connects the detection circuit, in the blanking period, to the first signal line in order to cause the detection circuit to detect the pixel state, and connects, in the display period, the detection circuit to the second signal line in order to cause the detection circuit to detect the external state.

2. An image display device as defined in claim 1, wherein said detection circuit includes an amplifier for amplifying the output of the detection state, and setting values of said amplifier can be set from subjects to-be-detected and characteristics thereof which correspond to the plurality of detection states which are the external state and the pixel state.

3. An image display device as defined in claim 2, wherein said detection circuit controls a setting of the detection path and a setting of said amplifier in interlocking.

4. An image display device as defined in claim 2, wherein the setting values of said amplifier are setting values which are determined for the respective subjects to-be-detected.

5. An image display device as defined in claim 4, comprising a circuit for dynamically calculating the setting values determined for the respective subjects to-be-detected.

6. An image display device as defined in claim 2, wherein there are a plurality of the sensor unit and the second signal line is provided with respect to each of the sensor units and the first switch circuit changes over in any desired sequence the second signal line which becomes connected to the detection circuit in the display period.

7. An image display device as defined in claim 6, comprising a circuit for setting priority levels for the subjects to-be-detected.

8. An image display device as defined in claim 2, comprising a circuit for changing-over said outputting power source and said displaying power source, in accordance with the subjects to-be-detected.

* * * * *